United States Patent [19]

Shilling et al.

[11] 4,030,950

[45] June 21, 1977

[54] PROCESS FOR CUBE-ON-EDGE ORIENTED BORON-BEARING SILICON STEEL INCLUDING NORMALIZING

[75] Inventors: Jack W. Shilling, Monroeville; Amitava Datta, Pittsburgh; Frank A. Malagari, Jr., Freeport, all of Pa.

[73] Assignee: Allegheny Ludlum Industries, Inc., Pittsburgh, Pa.

[22] Filed: June 17, 1976

[21] Appl. No.: 696,966

[52] U.S. Cl. ..... 148/112; 148/31.55; 148/111; 148/113

[51] Int. Cl.[2] ..... H01F 1/04

[58] Field of Search ..... 148/113, 112, 111, 31.55, 148/16 DE

[56] References Cited

UNITED STATES PATENTS

| | | | |
|---|---|---|---|
| 2,455,632 | 12/1948 | Williams | 148/16 DE |
| 3,159,511 | 12/1964 | Taguchi et al. | 148/111 |
| 3,345,219 | 10/1967 | Detert | 148/112 |
| 3,954,521 | 5/1976 | Malagari | 148/111 |

*Primary Examiner*—Walter R. Satterfield
*Attorney, Agent, or Firm*—Vincent G. Gioia; Robert F. Dropkin

[57] ABSTRACT

A process for producing electromagnetic silicon steel having a cube-on-edge orientation and a permeability of at least 1870 ($G/O_e$) at 10 oersteds. The process includes the steps of: preparing a melt of silicon steel containing from 0.02 to 0.06% carbon, from 0.0006 to 0.0080% boron, up to 0.0100% nitrogen, no more than 0.008% aluminum and from 2.5 to 4.0% silicon; casting said steel; hot rolling said steel; cold rolling said steel; normalizing said steel at a temperature of from 1300° to 2000° F in a hydrogen-bearing atmosphere having a dew point of from +20° to +110° F; applying a refractory oxide base coating to said steel; and final texture annealing said steel. The variables of time, temperature and dew point are monitored during normalizing so as to result in a steel having at least 320 parts per million of oxygen, based on the total weight of the steel, within 10 microns of the surfaces of said steel.

12 Claims, No Drawings

PROCESS FOR CUBE-ON-EDGE ORIENTED BORON-BEARING SILICON STEEL INCLUDING NORMALIZING

The present invention relates to an improvement in the manufacture of grain-oriented silicon steel.

Although U.S. Pat. Application Ser. No. 577,571, filed May 15, 1975, now U.S. Pat. No. 4,000,015 discloses a most effective process for producing electromagnetic silicon steel having a cube-on-edge orientation, a shortcoming is said process has been noted. By utilizing a hydrogen bearing atmosphere having a dew point of from +20 to +60° F during the final normalize-decarburization stage of processing, said process developed a final normalized steel which was not susceptible to formation of certain base coatings. Through the present invention, we now provide a process which overcomes this shortcoming of Ser. No. 577,571.

According to the present invention, boron-bearing silicon steel is normalized at a temperature of from 1300° to 2000° F in a hydrogen-bearing atmosphere having a dew point of from +20 to +110° F, and preferably from +40 to +85° F, for a period of time sufficient to lower the steel's carbon content to a level below 0.005%; and under such control of temperature, dew point and time so as to result in a steel having at least 320 parts per million of oxygen, based upon the total weight of the steel, within 10 microns of the surfaces of the steel. Unlike U.S. Pat. No. 3,873,381, the present invention does not employ a wet decarburizing atmosphere, and unlike Pat. Nos. 3,905,842, 3,905,843 and 3,957,546, the present invention specifically controls the variables of time, temperature and dew point so as to produce a steel having at least 320 parts per million of oxygen, as noted hereinabove.

It is accordingly an object of the present invention to provide an improvement in the manufacture of grain-oriented silicon steel.

In accordance with the present invention a melt of silicon steel containing from 0.02 to 0.06% carbon, from 0.0006 to 0.0080% boron, up to 0.0100% Nitrogen, no more than 0.008% aluminum and from 2.5 to 4.0% silicon is subjected to the conventional steps of casting, hot rolling, one or more cold rollings, an intermediate normalize when two or more cold rollings are employed, application of a refractory oxide base coating, and final texture annealing; and to the improvement comprising the step of normalizing the cold rolled steel of final gage at a temperature of from 1300° to 2000° F in a hydrogen-bearing atmosphere having a dew point of from +20° to +110° F for a period of time sufficient to lower the steel's carbon content to a level below 0.005%, and significantly, under control of temperature, dew point and time so as to yield a steel having at least 320 parts per million of oxygen, based on the total weight of the steel, within 10 microns of the surfaces of the steel. Specific processing, as to the conventional steps, is not critical and can be in accordance with that specified in any number of publications including U.S. Pat. No. 2,867,557 and the other patents cited hereinabove. Moreover, the term casting is intended to include continuous casting processes. A hot rolled band heat treatment is also includable within the scope of the present invention. It is, however, preferred to cold roll the steel to a thickness no greater than 0.020 inch, without an intermediate anneal between cold rolling passes; from a hot rolled band having a thickness of from about 0.050 to about 0.120 inch. Melts consisting essentially of, by weight, 0.02 to 0.06% carbon, 0.015 to 0.15% manganese, 0.01 to 0.05% of material from the group consisting of sulfur and selenium, 0.0006 to 0.0080% boron, up to 0.0100% nitrogen, 2.5 to 4.0% silicon, up to 1.0% copper, no more than 0.008% aluminum, balance iron, have proven to be particularly adaptable to the subject invention. Boron levels are usually in excess of 0.0008%. The refractory oxide base coating usually contains at least 50% MgO. Steel produced in accordance with the present invention has a permeability of at least 1870 ($G/O_e$) at 10 oersteds.

The present invention improves upon that of referred to Ser. No. 577,571 by providing at least 320 parts per million of oxygen, based on the total weight of the steel, in the outer 10 microns of the steel. By referring to the outer 10 microns, the invention is making specific reference to the outer 5 microns which include the scale formed during the final normalized. Oxygen present as oxides in the scale is necessary to render the surfaces of the steel susceptible to the formation of a wide variety of base coatings. It is obtained by increasing the duration of the normalize, by subjecting the steel to a temperature within the upper portion of the normalizing range for a short period of time, or by any other mode which is evident to one skilled in the art after reading the subject disclosure. The benefit of forming oxides must however be weighted against the need for good magnetics. Ser. No. 577,571 has taught us that the magnetics of steel produced from boron-bearing melts improves with the use of final normalizing atmospheres having a low dew point. As a result, a hydrogen-bearing atmosphere having a dew point of from +40° to +85° F, is herein preferred. High dew points deboronize a boron-bearing steel, thereby reducing the effect of boron as an inhibitor; and as a result thereof are responsible for a deterioration of magnetic properties.

The cold rolled steel is usually at a temperature within the final normalizing temperature range of from 1300° to 2000° F for a period of from ten seconds to ten minutes. As decarburization proceeds most effectively at temperatures of about 1475° F, it is preferred to normalize at a temperature of from 1400° to 1550° F. The hydrogen-bearing atmosphere of the final normalize can be one consisting essentially of hydrogen or one containing hydrogen admixed with nitrogen. A gas mixture containing 80% nitrogen and 20% hydrogen has been successfully employed.

The following examples are illustrative of several aspects of the invention.

EXAMPLE I

Samples from three heats (Heats A, B and C) of silicon steel were normalized at 1475° F for approximately five minutes at dew points ranging from +30° to +100° F. The chemistry of the heats appears hereinbelow in Table I.

TABLE I

| | Composition (wt. %) | | | | | | | | |
|---|---|---|---|---|---|---|---|---|---|
| Heat | C | Mn | S | B | N | Si | Cu | Al | Fe |
| A | 0.038 | 0.039 | 0.020 | 0.0009 | 0.0041 | 3.17 | 0.36 | 0.005 | Bal. |

TABLE I-continued

| Heat | Composition (wt. %) | | | | | | | | |
|---|---|---|---|---|---|---|---|---|---|
| | C | Mn | S | B | N | Si | Cu | Al | Fe |
| B | 0.030 | 0.034 | 0.020 | 0.0011 | 0.0043 | 3.12 | 0.35 | 0.004 | Bal. |
| C | 0.043 | 0.035 | 0.020 | 0.0009 | 0.0049 | 3.24 | 0.34 | 0.004 | Bal. |

The oxygen content of the scale for samples from each heat was determined. Said results appear hereinbelow in Table II, along with the normalizing conditions.

TABLE II

| Sample | Normalizing Dew Point (° F) | Normalizing Atmosphere (%) | Oxygen* In Scale (ppm) |
|---|---|---|---|
| $A_1$ | +30 | $H_2$ | 49 |
| $A_2$ | +50 | 80 $N_2$ - 20 $H_2$ | 197 |
| $A_3$ | +100 | 80 $N_2$ - 20 $H_2$ | 349 |
| $B_1$ | +30 | $H_2$ | 26 |
| $B_2$ | +50 | 80 $N_2$ - 20 $H_2$ | 152 |
| $B_3$ | +100 | 80 $N_2$ - 20 $H_2$ | 328 |
| $C_1$ | +30 | $H_2$ | 24 |
| $C_2$ | +50 | 80 $N_2$ - 20 $H_2$ | 172 |
| $C_3$ | +100 | 80 $N_2$ - 20 $H_2$ | 360 |

*based on total weight of the steel

Samples $A_1$ through $A_3$, $B_1$ through $B_3$ and $C_1$ through $C_3$ were coated with MgO refractory oxide base coating, final texture annealed at a maximum temperature of 2150° F in hydrogen, and examined for coating quality. The results of the examination appear hereinbelow in Table III.

TABLE III

| Sample | Oxygen in* Scale (ppm) | Coating |
|---|---|---|
| $A_1$ | 49 | Bare |
| $A_2$ | 197 | Thin & porous |
| $A_3$ | 349 | Opaque |
| $B_1$ | 26 | Bare |
| $B_2$ | 152 | Thin & porous |
| $B_3$ | 328 | Opaque |
| $C_1$ | 24 | Bare |
| $C_2$ | 172 | Thin & porous |
| $C_3$ | 360 | Opaque |

*based on total weight of the steel

As a high quality base coating should be opaque, it is clear that only Samples $A_3$, $B_3$ and $C_3$ were susceptible to formation of a high quality MgO base coating. Significantly, these samples all had over 320 ppm of oxygen in their scale (based on the total weight of the steel). On the other hand, Samples $A_2$, $B_2$ and $C_2$ and $A_1$, $B_1$ and $C_1$ were respectively, only susceptible to formation of thin and porous, and bare base coatings. Notably, samples $A_2$, $B_2$ and $C_2$ all had less than 200 ppm oxygen in their scale (based on the total weight of steel), whereas Samples $A_1$, $B_1$ and $C_1$, all had less than 50 ppm oxygen in their scale (based on the total weight of the steel).

EXAMPLE II

Two heats (Heats D and E) were melted and processed into a coil of high permeability silicon steel having a cube-on-edge orientation. The chemistry of the heats appears hereinbelow in Table IV.

TABLE IV

| Heat | Composition (wt. %) | | | | | | | | |
|---|---|---|---|---|---|---|---|---|---|
| | C | Mn | S | B | N | Si | Cu | Al | Fe |
| D | 0.030 | 0.035 | 0.020 | 0.0009 | 0.0044 | 3.22 | 0.36 | 0.004 | Bal. |
| E | 0.030 | 0.035 | 0.019 | 0.0011 | 0.0046 | 3.22 | 0.36 | 0.004 | Bal. |

Processing for the heats involved soaking at an elevated temperature for several hours, hot rolling to a nominal gage of 0.080 inch, hot roll band normalizing at a temperature of approximately 1740° F, cold rolling to final gage, coil preparation, normalizing in an 80% $N_2$ - 20% $H_2$ atmosphere, coating with an MgO refractory oxide base coating and final texture annealing at a maximum temperature of 2150° F in hydrogen. Normalizing took place in two stages, as described hereinbelow in Table V.

TABLE V

| Heat | First Normalize | | | Second Normalize | | |
|---|---|---|---|---|---|---|
| | Temp. (° F) | Time (Mins.) | Dew Point (° F) | Temp. (° F) | Time (Mins.) | Dew Point (° F) |
| D | 1475 | 2 | +6 | 1475 | 2 | +50 |
| E | 1475 | 2 | +50 | 1475 | 2 | +50 |

After normalizing, the carbon content for both heats was below 0.005%.

The oxygen content of the scale for the inside center of the normalized coils was determined. Said results appear hereinbelow in Table VI, along with an evaluation of the base coating formed.

TABLE VI

| Heat | Oxygen in* Scale (ppm) | Coating |
|---|---|---|
| D | 258 | Non-uniform<br>Very thin & porous<br>Regions discolored |
| E | 370 | Uniform mostly opaque |

*based on total weight of the steel

Significantly, a high quality base coating formed on the coil from Heat E which had 370 ppm oxygen in the scale (based on the total weight of the steel), and not on the coil from Heat D which had only 258 ppm oxygen in the scale (based on the total weight of the steel). The present invention, as noted hereinabove, requires at least 320 ppm oxygen in the outer 10 microns of the steel, based on the total weight of the steel.

The coils from Heats D and E were subsequently tested for permeability and core loss. The results of the tests appear hereinbelow in Table VII.

TABLE VII

| Heat | | Core Loss (WPP at 17 KB) | Permeability (at 10 $O_e$) |
|---|---|---|---|
| D | In | 0.661 | 1907 |
| | Out | 0.739 | 1892 |
| E | In | 0.709 | 1884 |
| | Out | 0.732 | 1876 |

From Table VII it is clear that the magnetic properties of the coil from Heat D are superior to those of the coil from Heat E; as one would expect from the teachings of heretofore referred to U.S. Pat. Application Ser. No. 577,571. However, as noted hereinabove, the normalized D coil did not form a high quality MgO refractory oxide base coating. The present invention therefore improves upon that of Ser. No. 577,571, in that it teaches a process for obtaining high permeability silicon steel from a boron-bearing melt, and at the same time allows for formation of many high quality base coatings.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. In a process for producing electromagnetic silicon steel having a cube-on-edge orientation and a permeability of at least 1870 ($G/O_e$) at 10 oersteds, which process includes the steps of: preparing a melt of silicon steel containing from 0.02 to 0.06% carbon, from 0.0006 to 0.0080% boron, up to 0.0100% nitrogen, no more than 0.008% aluminum and from 2.5 to 4.0% silicon; casting said steel; hot rolling said steel; cold rolling said steel; decarburizing said steel, applying a refractory oxide base coating to said steel; and final texture annealing said steel; the improvement comprising the steps of normalizing said cold roller steel at a temperature of from 1300 to 2000° F in a hydrogen-bearing atmosphere having a dew point of from +20 to +110° F for a period of time sufficient to lower said steel's carbon content to a level below 0.005%, said temperature, dew point and time being monitored so as to result in a steel having at least 320 parts per million of oxygen, based on the total weight of the steel, within 10 microns of the surfaces of said steel; and forming an opaque refractory oxide base coating on said steel.

2. The improvement according to claim 1, wherein said melt has at least 0.0008% boron.

3. The improvement according to claim 2, wherein said steel is normalized at a temperature of from 1400° to 1500° F.

4. The improvement according to claim 2, wherein said steel is normalized in a hydrogen-bearing atmosphere having a dew point of from +40° to +85° F.

5. The improvement according to claim 2, wherein said steel is normalized for a period of from ten seconds to ten minutes.

6. The improvement according to claim 2, wherein said hydrogen-bearing atmosphere consists essentially of hydrogen and nitrogen.

7. The improvement according to claim 4, wherein said hydrogen-bearing atmosphere consists essentially of hydrogen and nitrogen.

8. The improvement according to claim 2, wherein said refractory oxide coating contains at least 50% MgO.

9. The improvement according to claim 2, wherein said hot rolled steel has a thickness of from 0.050 to 0.120 inch and wherein said hot rolled steel is cold rolled to a thickness of no more than 0.020 inch without an intermediate anneal between cold rolling passes.

10. The improvement according to claim 1, wherein said melt consists essentially of, by weight, 0.02 to 0.06% carbon, 0.015 to 0.15% manganese, 0.01 to 0.05% of material from the group consisting of sulfur and selenium, 0.0006 to 0.0080% boron, up to 0.0100% nitrogen, 2.5 to 4.0% silicon, up to 1.0% copper, no more than 0.008% aluminum, balance iron.

11. The improvement according to claim 10, wherein said melt has at least 0.0008% boron.

12. A cube-on-edge oriented silicon steel having a permeability of at least 1870 ($G/O_e$) at 10 oersteds, and made in accordance with the process of claim 2.

* * * * *